US006666236B2

(12) United States Patent
Oliverio

(10) Patent No.: US 6,666,236 B2
(45) Date of Patent: Dec. 23, 2003

(54) MODULAR PRODUCT FEED

(75) Inventor: Frank G. Oliverio, Cincinnati, OH (US)

(73) Assignee: R. A. Jones & Co., Inc., Crescent Springs, KY (US)

( * ) Notice: Subject to any disclaimer, the term of this patent is extended or adjusted under 35 U.S.C. 154(b) by 109 days.

(21) Appl. No.: 10/032,677

(22) Filed: Nov. 1, 2001

(65) Prior Publication Data

US 2003/0079802 A1 May 1, 2003

(51) Int. Cl.[7] ..... B65B 3/16
(52) U.S. Cl. ..... 141/114
(58) Field of Search ..... 141/1, 10, 114, 141/144, 145, 152, 166, 177, 231, 232, 233, 387

(56) References Cited

U.S. PATENT DOCUMENTS 3,821,873 A * 7/1974 Benner et al. ..... 53/437
4,232,504 A 11/1980 Dieterlen et al. ..... 53/570
4,300,602 A 11/1981 Vadas ..... 141/103
4,344,269 A 8/1982 Dieterlen et al. ..... 53/459
5,115,843 A * 5/1992 Bayliss ..... 141/1
5,320,146 A * 6/1994 Stevie ..... 141/1
5,551,492 A 9/1996 Rack et al. ..... 141/147
5,605,183 A 2/1997 Hartman et al. ..... 141/237
5,762,116 A 6/1998 Moore ..... 141/145

* cited by examiner

*Primary Examiner*—Gregory L. Huson
*Assistant Examiner*—Peter deVore
(74) *Attorney, Agent, or Firm*—Wood, Herron & Evans LLP

(57) ABSTRACT

A pouch machine includes a modular feeder having feeder components mounted in a module. The pouch machine has a common socket for receiving a selected one of a plurality of feeder modules in operative position proximate a pouch filler apparatus.

4 Claims, 2 Drawing Sheets

FIG. I

MODULAR PRODUCT FEED

FIELD OF THE INVENTION

This invention relates to pouch forming, filling and sealing apparatus and more particularly to an improved feeder for feeding product to a pouch filler wheel.

BACKGROUND OF THE INVENTION

In the past, pouching machines entrain an indeterminate length of partially formed pouches about a filler wheel for filling with product. Typically, the products handled by one machine are fed through a spout plate to a filler wheel by a feeder mounted above the filler wheel. The feeders are generally specific to the types, number and unit volumes of the products to be deposited in the pouches and since the filler wheels typically are driven and supported by spindles extending above the filler wheel assemblies (including spout plates) and are supported by bearings, hubs and frames above the wheels, the feeders and their mounting apparatus require a design to avoid interference with the frame and bearing structure supporting the extending spindle.

Thus, changeover from one type feeder to another is problematical; each feeder must be designed to a specific configuration accommodating the particular spindles supporting structure of each filler wheel. Changeover is thus problematical and expensive at best, requiring feeders and mounting structures specific to the support structure and to the feeder.

It has thus been one objective of this invention to provide an improved apparatus wherein a variety of different feeders can be easily mounted in a pouch filling apparatus.

To these ends, a preferred embodiment of the invention contemplates the use of a spindle-less filler wheel (i.e. a pouch filler wheel assembly having no spindle extending above its general plane of operation).

A module socket is mounted proximate, in this case above, the filler wheel. Such socket comprises, for example, two rails extending preferably horizontally over the filler wheel, and supported by the frame of a machine housing or cover.

A feeder module comprising a module frame, complementary rails, and a feeder is removably mounted on the socket rails, over the filler wheel for feeding product to it. When desired to change over to a different feeder for different product, or different unit volume, for example, the feeder module in place is simply removed and another desired feeder, mounted in a module frame, is operably disposed on the socket rails.

In this manner, there are no spindle hubs or support frames above the filler wheel to interfere with the positioning of the modular feeder. The socket rails are fixed, and a variety of feeder modules, such as cup feeders, belt feeders, auger feeders and the like can easily and alternatively be operably disposed over a pouch filler wheel.

Moreover, it will be appreciated that the module feeder can include a spout plate in association with the feeder module, or a spout plate can be mounted on or over the filler wheel for operation with a modular feeder mounted thereover.

These and other objectives and advantages will become readily apparent to those of ordinary skill in the art from the following description of a preferred and other embodiments of the invention and from the drawings in which:

DETAILED DESCRIPTION

Figure 1:
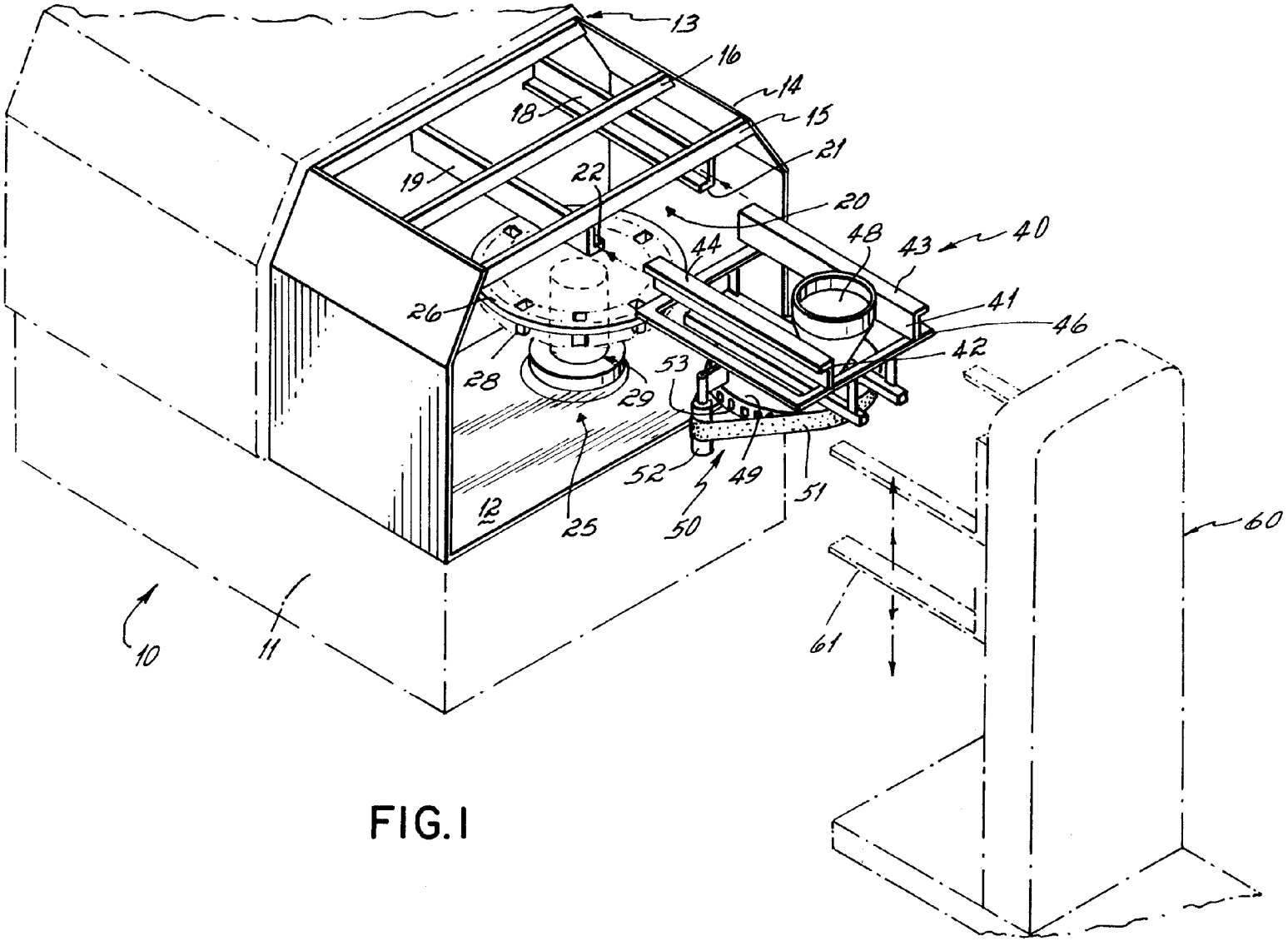
FIG. 1 is a perspective view of one embodiment of the invention and illustrating the assembly of a feeder module to a pouch forming, filling and sealing operation.

Turning now to the drawings, there is shown a pouch forming, filling and sealing machine 10. Machine 10 is similar, except as modified by the invention described herein, to the pouch machine known as the PK2000, PK3000 and PK4000, made and sold by R. A. Jones & Co. Inc. of Crescent Springs, Ky. and, for example, to such machines as described and illustrated in U.S. Pat. Nos. 4,702,289; 4,848,421; 5,060,450; 5,320,146; 5,502,951 and 6,119,440 all of which are expressly incorporated herein by reference.

Machine 10 includes a base 11, including a top plate 12 and a housing 13. Housing 13 includes an end housing 14 with a housing frame 15, 16 to which are mounted parallel rails 18, 19 of a socket 20. Socket 20 is defined in part by the rails 18, 19. Each rail 18, 19 has a respective horizontally oriented leg 21, 22.

In machine 10, there is a filler wheel assembly 25 mounted above top plate 12 of machine 10, within housing 14. In this embodiment, filler wheel assembly 25 (see FIG. 2) includes a spout plate 26 and a filler wheel 27. Filler wheel 27 is provided with a plurality of lands (not shown in detail) onto which the transverse seals in a pouch train are held while the connected pouches move about the filler wheel 27 for filling in any conventional manner. Products flow through spouts 28 into pouches on the lands, also in any conventional manner. The spout plate 26 and filler wheel 27 are coordinated as is well known, so that spouts 28 align with open tops of pouches on the filler wheel lands (see the left side of FIG. 2) as well known.

It will be appreciated that the filler wheel 27 and spout plate 26 in this embodiment are driven by a shaft and hub assembly 29 which does not extend above spout plate 26, nor the filler wheel assembly 25 including the spout plate. Moreover, it will be appreciated that spacer hubs 30, 31 can be removed from assembly 29 when the spout plate 26 is omitted in favor of the structure of the feeder module to be described. Accordingly, the filler wheel assembly 25 is referred to for purposes of this application as a "spindle-less" filler wheel assembly 25, meaning that the drive shaft and hub components do not extend in any significant way about the components of the filler wheel assembly 25, and have no bearing or spindle mount thereabove.

Figure 2:
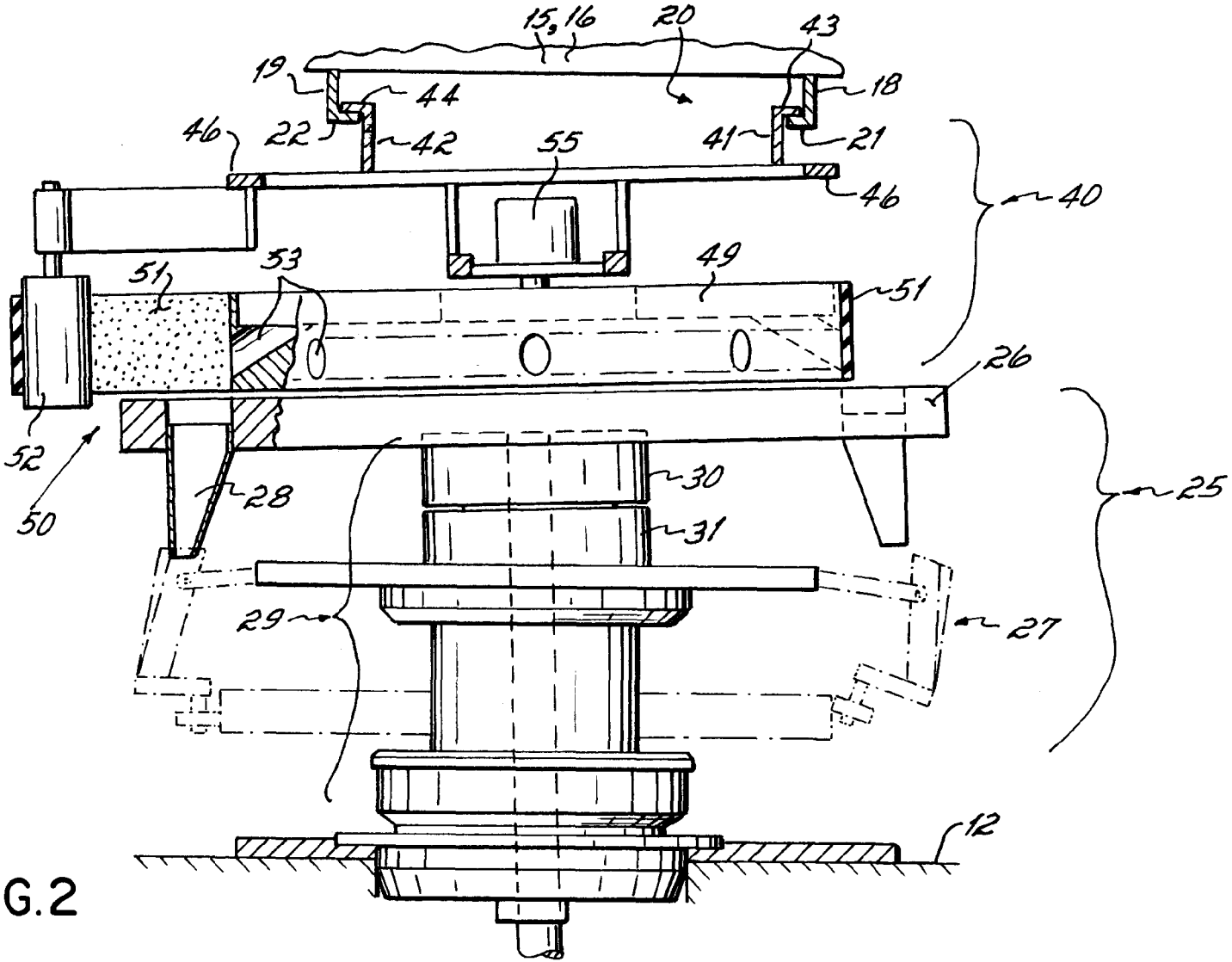
FIG. 2 is an elevational cross-section showing one form of feeder module operatively associated with a filler wheel.

A feeder module 40 is mounted in the pouch machine 10, its position being illustrated in FIG. 2. Feeder module 40 includes two rails, 41, 42, each having an elongated longitudinally extending flange 43, 44 operatively oriented for supporting engagement by legs 21, 22 respectively of rails 18, 19 of socket 20.

Rails 41, 42 are secured to a modular feeder frame 46. Supported on modular feeder frame 46 are components of product feeder. These may include, for example, a hopper 48, a wheel 49 of a feeder 50 and belt 51. Belt 51 is entrained about a wheel 49 except in the area where it is held away from wheel 49 by idler roller 52.

Openings 53 are uncovered by belt 51 to dispense product therefrom into the spouts 28 when module 40 is in operative position. A motor or servo 55 is mounted in module 40 for driving belt feeder 50.

For storing and/or lifting module 40 into place, a lifter 60 is provided. Lifter 60 includes a fork 61, reciprocally movable to raise a module 40 for sliding it horizontally into socket 20, or removing it horizontally out of socket 20. Lifter 60 can be mobilized to move modules 40 between socket 20 and a storage position on a rack (not shown) for example. Lifter 60 can be driven electrically, pneumatically, hydraulically or in any other suitable fashion.

In use, a feeder module such as module 40 is slid onto rails 21, 22. Flanges 43, 44 of the module slide onto legs 21, 22 which hold the module 40 in operative position over filler wheel assembly 25. Upon insertion into socket 20, appropriate operative interconnection can be made to the feeder, including electrical, hydraulic, pneumatic and control couplings (not shown) for driving and controlling the module. Also, various bolts, clamps or other suitable fasteners can be used to secure the rails 41, 42 of the module within socket 20.

It will be appreciated that module 40 in the embodiment described includes components of a feeder, such as belt feeder 50. A variety of feeders, of course, could be used, such as ring, cup, belt and augur feeders, all in a module such as module 40, each including a common pair of rails 41, 42 for operative interfacing with rails 18, 19 of the common socket 20. Accordingly, other modules may include a spout plate mounted on the feeder module, rather than as part of the filler wheel assembly 25.

In the case of module 40, the feeder components are drawn in timed register with the components of the filler wheel assembly 25, in any well known fashion, which may, but not necessarily, include servo-driven positional feedbacks and monitoring and digital controls.

Accordingly, the invention contemplates other use of a feeder module 40 operatively mounted in a common socket 20. When it is desired to change product, a product unit volume beyond the range of the current module 40, or to change the number of products dispersed into pouches, another feeder module, having feeder components as desired, is selected. The current module 40 is decoupled and removed, sliding horizontally out of the socket 20. A new module is thus introduced into socket 20, sliding horizontally therein, and operatively coupled for a different feeding operation in the same common socket 20 and pouch machine 10. Because no spindle or spindle support structure extends above the filler wheel structure 25, the module removal and the insertion and coupling of the new module is unfettered.

It should also be appreciated that modules may be provided with various types of feeders, or even multiple feeders, where discharge from multiple feeders is useful.

These and other modifications and advantages will become readily apparent to those of ordinary skill in the art without departing from the scope of this invention and the applicant intends to be bound only by the claims appended hereto.

What is claimed is:

1. A pouch forming, filling and sealing apparatus comprising:

a filler wheel;

a socket operably disposed proximate said filler wheel;

a feeder for supplying product to said filler wheel for deposit in pouches;

said feeder being removably mounted on said socket for feeding said filler wheel; and wherein said socket comprises a pair of rails, said feeder having rail receiving elements for sliding onto said socket rails to operably position said feeder over said filler wheel.

2. A pouch apparatus as in claim 1 further including a plurality of feeders, each selectively mountable by said socket over said filler wheel for providing product thereto.

3. A pouch apparatus as in claim 1 including a plurality of feeders, wherein each feeder comprises a mechanical feeder of different structure than the other feeders.

4. A pouch apparatus as in claim 1 including a plurality of different feeders, each selectively mountable in said socket.

* * * * *